US006019619A

United States Patent [19]

Aoki et al.

[11] Patent Number: 6,019,619

[45] **Date of Patent: *Feb. 1, 2000**

[54] LIF CONNECTOR WITH A SLIDER AND RETRACTABLE PROJECTION

[75] Inventors: Hiroshi Aoki; Motohisa Kashiyama, both of Shizuoka, Japan

[73] Assignee: Yazaki Corporation, Tokyo, Japan

[ * ] Notice: This patent is subject to a terminal disclaimer.

[21] Appl. No.: 08/998,837

[22] Filed: Dec. 29, 1997

[30] Foreign Application Priority Data

Jan. 8, 1997 [JP] Japan ..... 9-001564

[51] Int. Cl.[7] ..... H01R 13/62

[52] U.S. Cl. ..... 439/157

[58] Field of Search ..... 439/157, 152, 439/153, 347, 344, 270, 953

[56] References Cited

U.S. PATENT DOCUMENTS

| | | | |
|---|---|---|---|
| 5,169,327 | 12/1992 | Hatagishi | 439/157 |
| 5,183,408 | 2/1993 | Hatagishi | 439/157 |
| 5,478,251 | 12/1995 | Jaklin | 439/157 |
| 5,618,194 | 4/1997 | Maue et al. | 439/157 |
| 5,618,195 | 4/1997 | Cappe | 439/157 |
| 5,816,833 | 10/1998 | Hanazaki | 439/157 |
| 5,924,880 | 7/1999 | Watanabe et al. | 439/157 |

FOREIGN PATENT DOCUMENTS

| | | | |
|---|---|---|---|
| 4-319271 | 11/1992 | Japan | H01R 13/629 |
| 611275 | 2/1994 | Japan | H01R 13/629 |
| 6-140094 | 5/1994 | Japan | H01R 13/502 |
| 6-215827 | 8/1994 | Japan | H01R 13/629 |
| 7-169529 | 7/1995 | Japan | H01R 13/629 |

*Primary Examiner*—Khiem Nguyen
*Assistant Examiner*—Michael Zarroli
*Attorney, Agent, or Firm*—Sughrue, Mion, Zinn, Macpeak & Seas, PLLC

[57] ABSTRACT

There is disclosed an LIF connector in which a reverse insertion of a slider can be detected rapidly and easily although the connector has a simple construction. The LIF connector includes an LIF (low insertion force) mechanism in which a slider is slidable over a first connector through guides, and by sliding the slider, a second connector can be inserted into and withdrawn from the first connector. A pair of retractable projections are provided respectively on opposed side walls of the slider, and each of the projections has an inclined surface and a substantially vertical abutment surface. When the slider is inserted with directions of its front and rear ends kept proper, the inclined surface is brought into sliding contact with the associated guide to thereby retract the projection. When the slider is inserted with the directions of its front and rear ends reversed, the abutment surface abuts against the associated guide to thereby prevent the insertion of the slider.

4 Claims, 11 Drawing Sheets

LIF CONNECTOR WITH A SLIDER AND RETRACTABLE PROJECTION

BACKGROUND OF THE INVENTION

This invention relates to an LIF connector having an LIF (low insertion force) mechanism by which a multi-pole connector, having many terminals, can be easily inserted into and withdrawn from a mating connector.

The term "connector", used in this specification of the present invention, means a connector including at least male terminals or female terminals, and a housing receiving these terminals therein, and the housing may be either separate from or integral with other member.

A multi-pole connector has a plurality of terminals, and therefore a large insertion/withdrawal force is required for inserting and withdrawing the connector relative to a mating connector, and it has been rather difficult to effect the insertion and withdrawal of the connector. In view of the difficulty of insertion and withdrawal of such a multi-pole connector, there have now been proposed various connectors (LIF connectors) having an LIF mechanism.

A representative example of such conventional LIF connectors includes one in which a connector is inserted and withdrawn by operating a slider.

One such conventional slider-type LIF connector is proposed in Japanese Patent Unexamined Publication No. Hei. 4-319271. FIG. 1 is an exploded, perspective view of the LIF connector disclosed in Japanese Patent Unexamined Publication No. Hei. 4-319271.

This LIF connector comprises a plurality of connectors 211 and 212, a rectangular frame-like holder 220 for receiving these connectors 211 and 212, a mating connector 230 for receiving the connectors 211 and 212 received in the holder 220, and a slider 240 of a generally U-shape for inserting and withdrawing the connectors 211 and 212 relative to the connector 230.

A pair of guide pins 221 and 221 are formed on each of upper and lower surfaces of the holder 220, and insertion holes 231 and 231 for the slider 240 are formed respectively through opposite end walls of the mating connector 230, and a pair of cam grooves 241 and 241, corresponding to the projections 221 and 221, are formed in each of upper and lower walls of the slider 240.

In the LIF connector of the above construction, the slider 240 is inserted into a predetermined position in the mating connector 230, and the guide pins 221 on the holder 220 are positioned respectively relative to the cam grooves 241 in the slider 240. Then, when the slider 240 is pushed into the mating connector 230, the guide pins 221 on the holder 220 move respectively along the cam grooves 241 in the slider 240, so that the connectors 211 and 212, received in the holder 220, are inserted into the mating connector 230.

Namely, in this LIF connector, by merely pushing the slider 240, the connectors 211 and 212 can be easily fitted into the mating connector 230.

However, in the above conventional slider-type LIF connector, the slider has a symmetrical configuration, and there have been occasions when the slider 240 has been inserted into the mating connector 230 in an inverted manner (that is, upside down), as indicated in dots-and-dash lines in FIG. 1.

The above conventional LIF connector is not provided with any means for preventing such inverted insertion of the slider 240, and the only way to prevent the inverted insertion of the slider 240 has been to confirm the direction of the cam grooves 241 with the eyes.

However, in order to find the inverted insertion of the slider 240 from the direction of the cam grooves 241, it is necessary first to understand the proper direction of the cam grooves 241, and then to judge whether or not the actual direction of the cam grooves 241 is proper.

The cam grooves 241 are formed in the inner side of the slider 240, and it has been difficult to recognize these cam grooves with the eyes. Particularly when the LIF connector is mounted within a vehicle body, it has been extremely difficult to see the thin cam grooves 241 in the dark.

Therefore, in the conventional slider-type LIF connector, the inverted insertion of the slider 240 has been noticed at the time when trying to engage each guide pin 221 on the holder 220 in an opening 241*a* of the associated cam groove 241.

Even in this case, each guide pin 221 and the associated opening 241*a* sometimes could not be properly positioned with respect to each other, and hence could not be engaged with each other, and therefore after all, the condition of the slider 240 was first confirmed with the eyes, and then the inverted insertion of the slider 240 could be realized.

Therefore, when the slider 240 was inserted in an inverted manner, much time was required before realizing this fact, and there was encountered a problem that the connectors 211 and 212 could not be inserted into the mating connector 230.

SUMMARY OF THE INVENTION

With the above problems in view, it is an object of this invention to provide an LIF connector in which a reverse insertion of a slider can be detected rapidly and easily although the connector has a simple construction.

The above object has been achieved by an LIF connector comprising an LIF (low insertion force) mechanism in which a slider is slidable over a first connector through guides, and by sliding the slider, a second connector can be inserted into and withdrawn from the first connector; wherein a pair of retractable projections are provided respectively on opposed side walls of the slider, and each of the projections has an inclined surface and a substantially vertical abutment surface, and when the slider is inserted with directions of its front and rear ends kept proper, the inclined surface is brought into sliding contact with the associated guide to thereby retract the projection, and when the slider is inserted with the directions of its front and rear ends reversed, the abutment surface abuts against the associated guide to thereby prevent the insertion of the slider.

More specifically, in the above-mentioned LIF connector, it is preferable that the first connector includes a reception portion for receiving the second connector, a through hole communicating with the reception portion, and the guides for guiding the slider, and the second connector includes a driven shaft for being inserted into the through hole in the first connector, and guide pins projecting perpendicularly from the driven shaft, and the slider includes a box-like body having an open bottom, slanting cam grooves formed respectively in the opposed side walls of the box so as to respectively guide the guide pins of the second connector, and the projections retractably mounted respectively on the opposed side walls.

In the LIF connector of the present invention, the slider is slid over the first connector, and with this construction the upper and lower sides of the slider can be clearly recognized. Namely, the slider has the open bottom so that it can be connected to the driven shaft of the second connector, and therefore the upper and lower sides of the slider can be clearly recognized with the eyes. As a result, the inverted insertion of the slider as encountered with the conventional slider 240 of FIG. 1 is prevented.

In the LIF connector of the invention, the front-rear reversed insertion of the slider is prevented by the retractable projections.

More specifically, if the slider is inserted between the guides, with its front and rear ends kept proper, when setting the slider relative to the guides of the first connector, the inclined surfaces of the projections are brought respectively into sliding contact with inner walls of the guides, and as the insertion of the slider proceeds, the projections are retracted to be entirely received in the side walls of the slider. Then, the slider is further inserted relative to the guides, and is set in a predetermined position on the first connector.

If the slider is inserted between the guides with its front and rear ends reversed, the abutment surfaces of the projections abut respectively against the guides, thereby preventing the insertion of the slider. Therefore, the reverse insertion of the slider can be detected rapidly and easily, and the reverse insertion of the slider is prevented.

DESCRIPTION OF THE PREFERRED EMBODIMENT OF THE INVENTION

One preferred embodiment of an LIF connector of the present invention will now be described with reference to the drawings.

Figure 2:
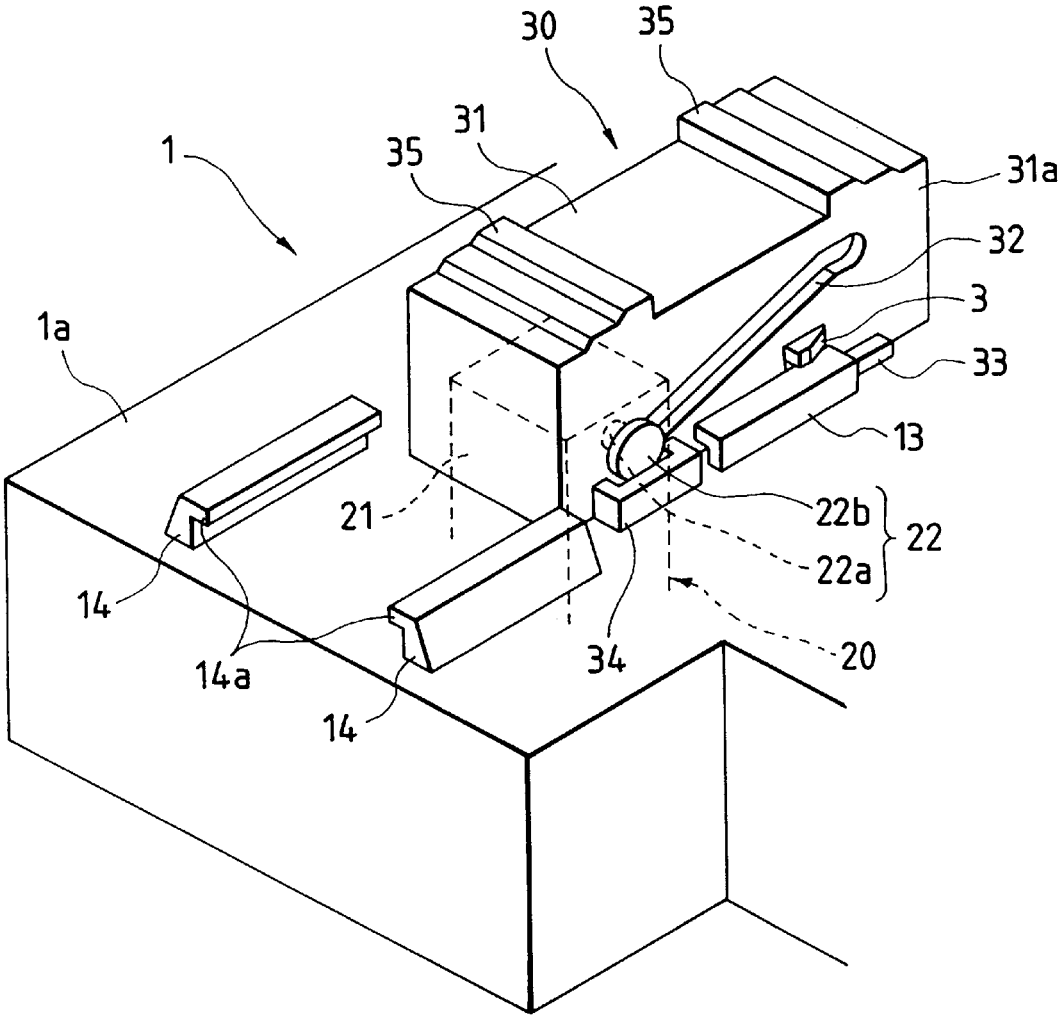
FIG. 2 is a perspective view of one preferred embodiment of an LIF connector of the present invention.
Figure 3:
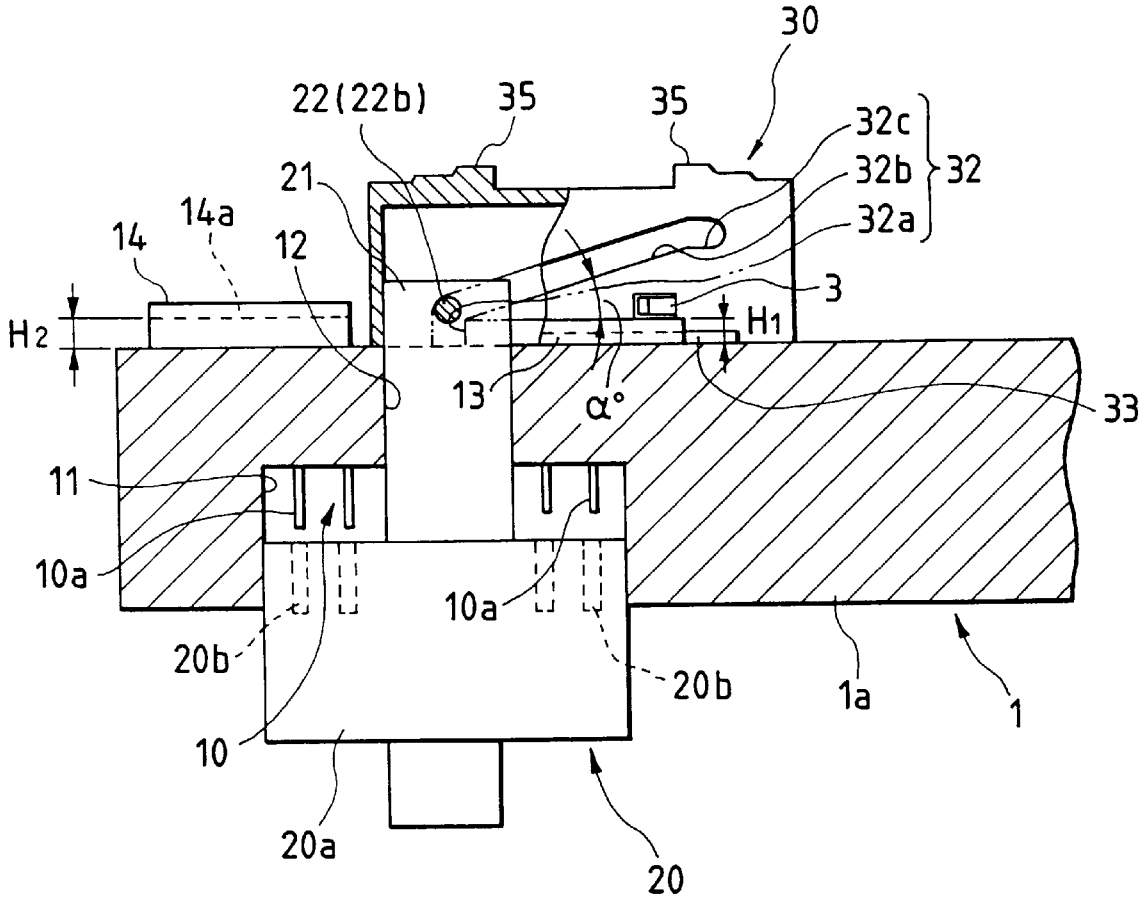
FIG. 3 is a cross-sectional view of the LIF connector.
Figure 4:
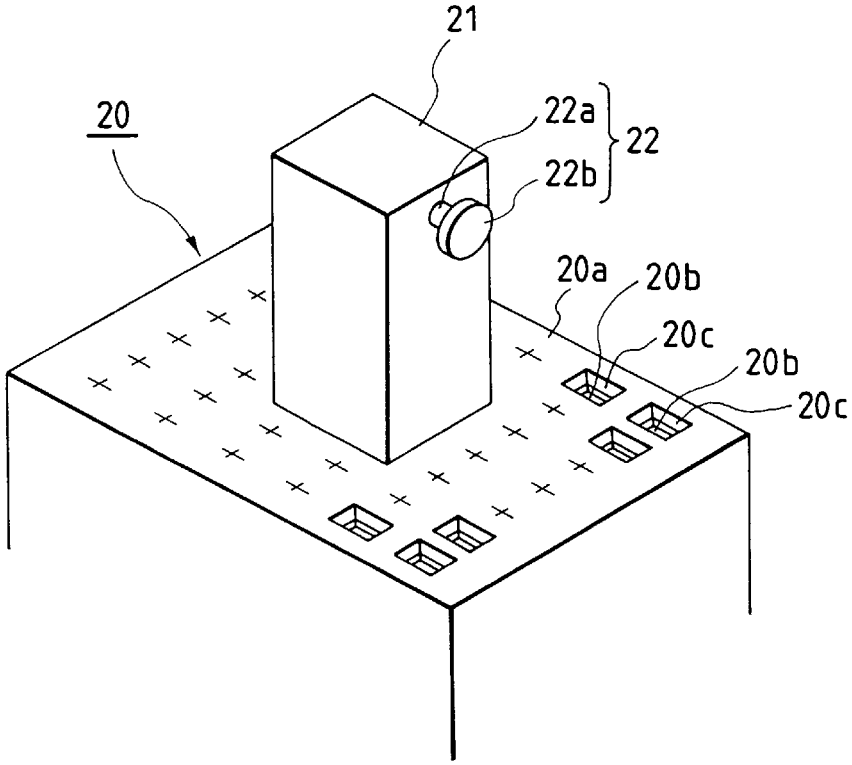
FIG. 4 is a perspective view of a second connector of the LIF connector.
Figure 5:
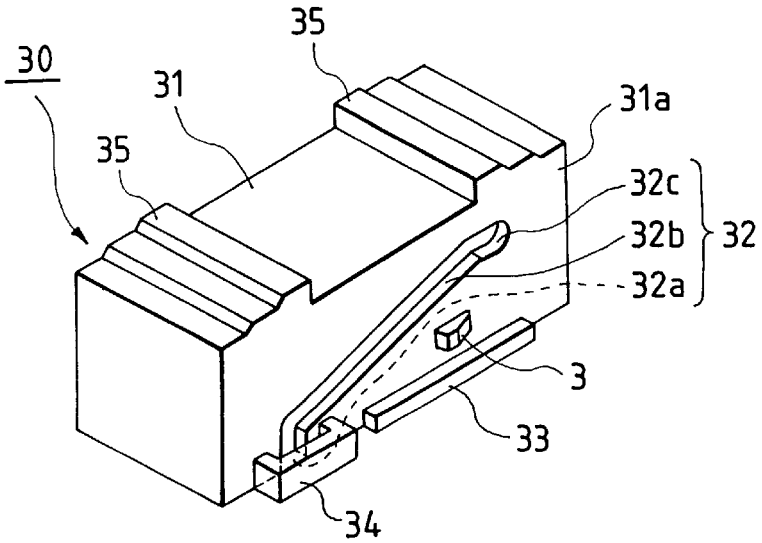
FIG. 5 is a perspective view of a slider of the LIF connector.

FIG. 2 is a perspective view of one preferred embodiment of the LIF connector of the invention, and FIG. 3 is a cross-sectional view of the LIF connector. FIG. 4 is a perspective view of a second connector of the LIF connector, and FIG. 5 is a perspective view of a slider of the LIF connector.

The LIF connector of the present invention is characterized particularly in that there are provided projections for preventing a reverse insertion of the slider, and applications have been filed for other portions of the undermentioned embodiment than these projections.

In these Figures, the LIF connector of this embodiment comprises a first connector 10 provided integrally in a junction box 1, the second connector 20 for being inserted into and withdrawn from the first connector 10, and the slider 30 for inserting and withdrawing the second connector 20 relative to the first connector 10.

In FIGS. 2 and 3, the first connector 10 is formed integrally in a housing la of the junction box 1, as described above. The first connector 10 includes a reception portion 11 for the second connector 20, and many male terminals 10*a* are projected into this reception portion 11. The male terminals 10*a*, which may be of varying lengths, are formed integrally with a bus bar wiring board (not shown) mounted in the junction block 1. A through hole 12, communicating with the reception portion 11, is formed in the housing 1*a*.

A pair of opposed guides 13 and 13 for respectively guiding rails 33 and 33 formed on the slider 30, as well as a pair of holder guides 14 and 14 for respectively guiding holders 34 and 34 formed on the slider 30, are formed on an upper surface of the housing 1*a*.

In FIGS. 2, 3 and 4, a driven shaft 21 for being inserted into the through hole 12 in the first connector 10 is formed upright at a central portion of the second connector 20. Guide pins 22 project perpendicularly from a distal end portion of the driven shaft 21. The guide pin 22 comprises a cylindrical shank portion 22*a*, and a disk-like stopper 22*b*.

Many female terminals 20*b*, corresponding respectively to the male terminals 10*a* of the first connector 10, are provided in a housing 20*a* of the second connector 20. The female terminals 20*b* are mounted respectively in cavities 20*c* formed in the housing 20*a*.

In FIGS. 2, 3 and 5, the slider 30 includes a box-like body 31 having an open bottom, and slanting cam grooves 32 and 32 for respectively guiding the guide pins 22 of the second connector 20 are formed respectively in opposite side walls 31*a* and 31*a* of the body 31.

As shown in FIG. 3, the cam groove 32 has an opening 32*a* for introducing the guide pin 22 of the driven shaft 21, a slanting groove 32*b* continuous with the opening 32*a*, and a horizontal groove 32*c* for stabilizing the guide pin 22 passed through the slanting groove 32*b*.

In FIG. 3, by reducing an inclination angle $\alpha°$ of the cam groove 32, a force for sliding the slider 30 (that is, an insertion/withdrawal force for the connectors 10 and 20) can be reduced. In contrast, by increasing the inclination angle $\alpha°$ of the cam groove 32, the distance of sliding of the slider 30 can be reduced.

The rails 33 and 33 are integrally formed respectively on the side walls 31*a* and 31*a* of the body 31, and extend respectively along lower edges of these side walls. The holders 34 and 34 for respectively guiding the guide pins 22 of the second connector 20 into the openings 32*a* are formed respectively on the side walls 31*a* and 31*a*, and are disposed outwardly of the openings 32*a* of the cam groove 32, respectively.

Anti-slip portions 35 for enabling the finger to smoothly slide the slider 30 are formed on the upper surface of the slider 30. In this embodiment, although the anti-slip portion 35 has a step-like configuration, it may be replaced by any other suitable configuration, such as a concave-convex configuration and a cross-sectionally serrated configuration in so far as it can prevent a slip of the finger.

Figure 6:
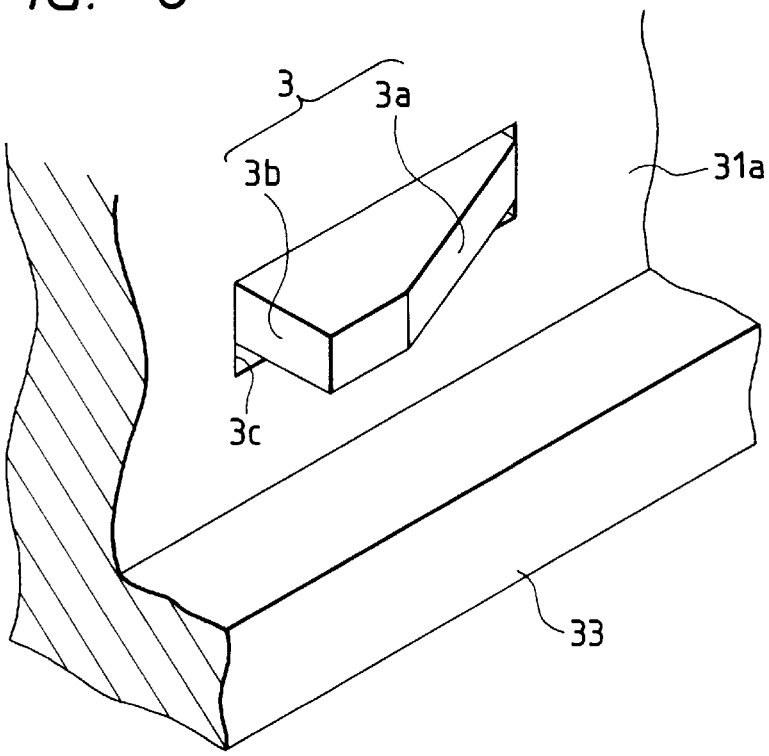
FIG. 6 is an enlarged, fragmentary view showing a reverse insertion prevention projection provided on the slider.

FIG. 6 is an enlarged, fragmentary view showing the retactable projections 3 provided on the slider 30. In this Figure, the pair of projections 3 are resiliently retractably mounted respectively on the opposed side walls 31*a* and 31*a* of the body 31 of the slider 30. As shown in FIGS. 2 and 3, the position $H_1$ of formation of each projection 3 is at the same height or level as the position $H_2$ of formation of an inturned portion 14*a* of the holder guide 14 of the first connector 10.

The projection 3 has an inclined surface 3*a* and a substantially vertical abutment surface 3*b*. When the slider 30 is inserted between the holder guides 14 with directions of its front and rear ends kept proper (see FIG. 7), the inclined surface 3*a* is brought into sliding contact with the holder guide 14 to thereby retract the projection 3. When the slider 30 is inserted between the holder guides 14 with the directions of its front and rear ends reversed (see FIG. 10), the abutment surface 3*b* abuts against the holder guide 14 to thereby prevent the insertion of the slider 30.

In order that each projection 3 can be extended and retracted relative to the side wall 31*a*, a groove 3*c* is formed in surrounding relation to an outer periphery of the projection.

The inserting operation of the slider 30 of the LIF connector of this embodiment will now be described with reference to FIGS. 7 to 11.

Figure 7:
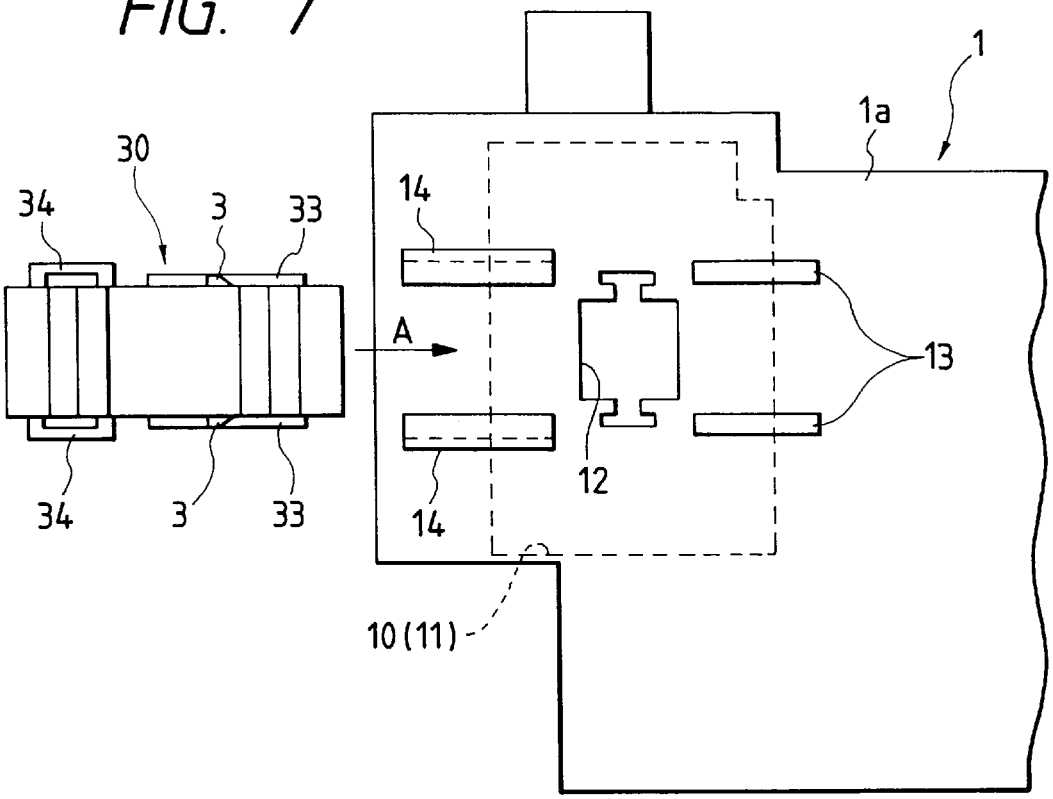
FIG. 7 is a view showing an operation effected when the slider is inserted with its front and rear ends kept proper.
Figure 8:
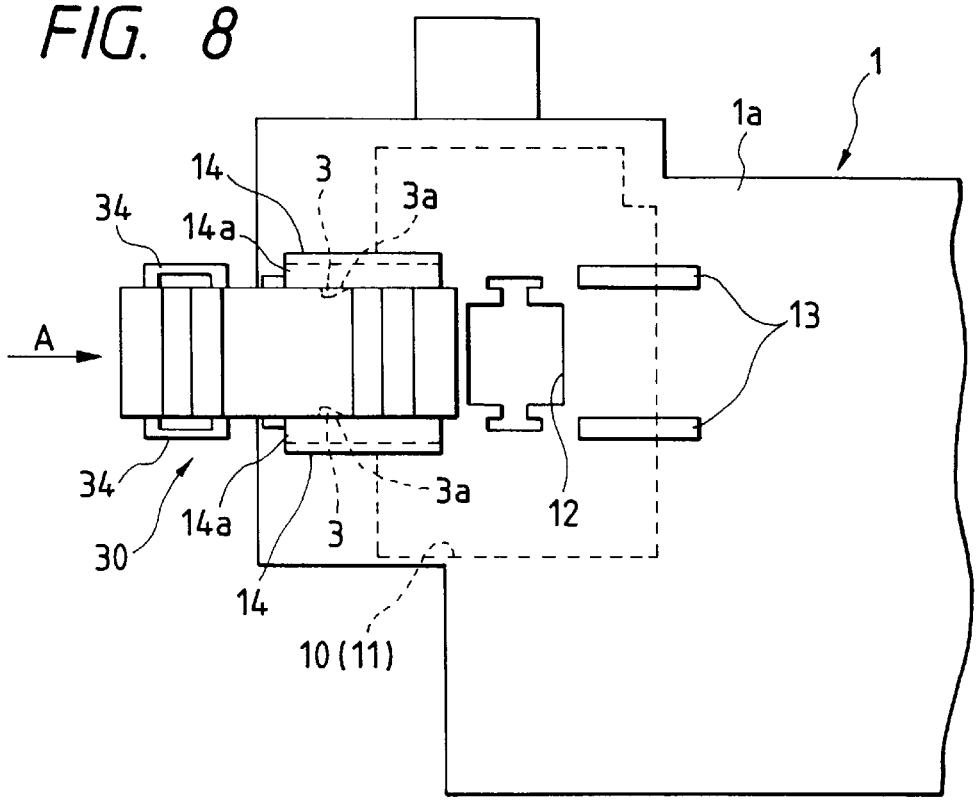
FIG. 8 is a view showing the operation effected when the slider is inserted with its front and rear ends kept proper.
Figure 9:
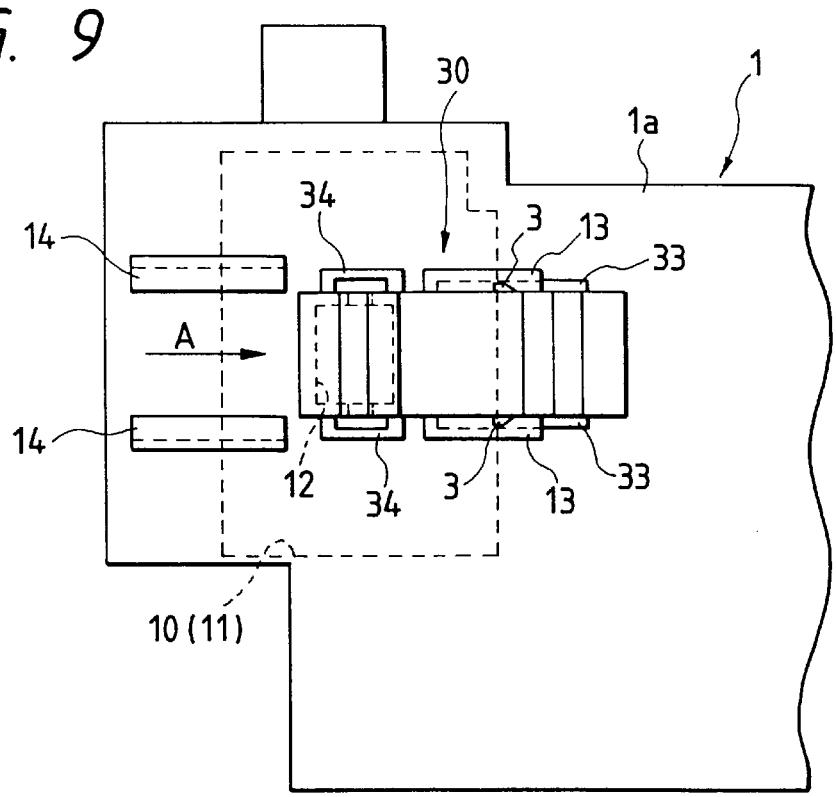
FIG. 9 is a view showing the operation effected when the slider is inserted with its front and rear ends kept proper.
Figure 10:
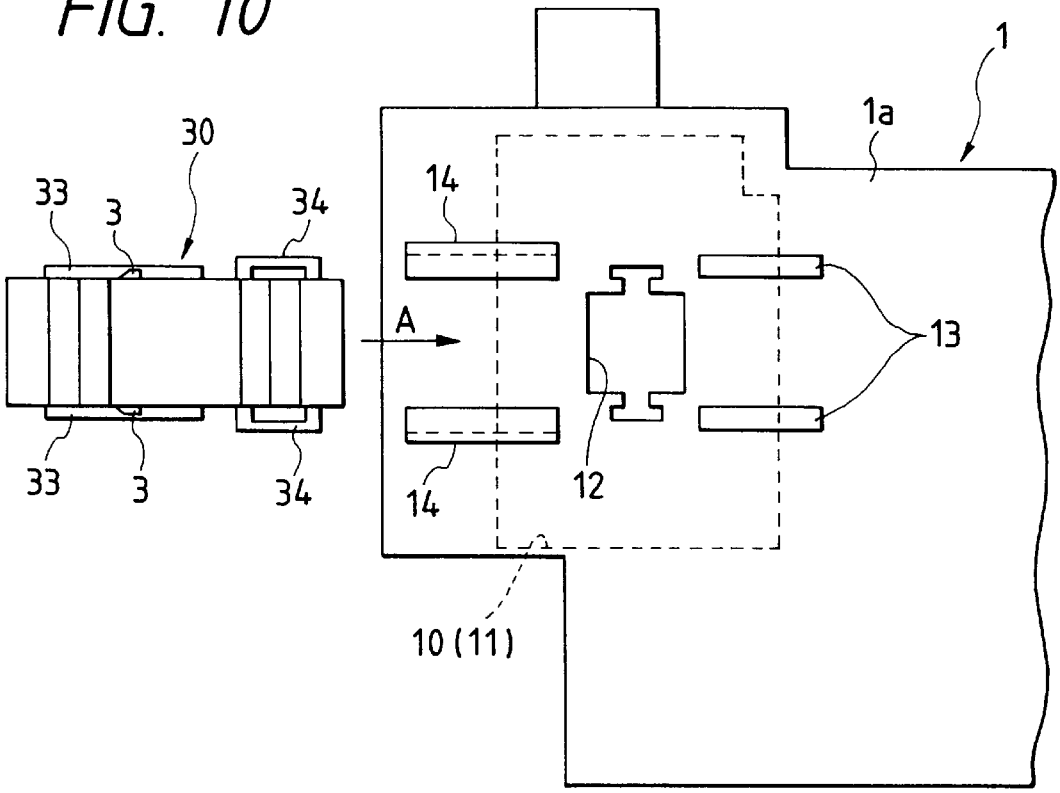
FIG. 10 is a view showing an operation effected when the slider is inserted with its front and rear ends reversed.
Figure 11:
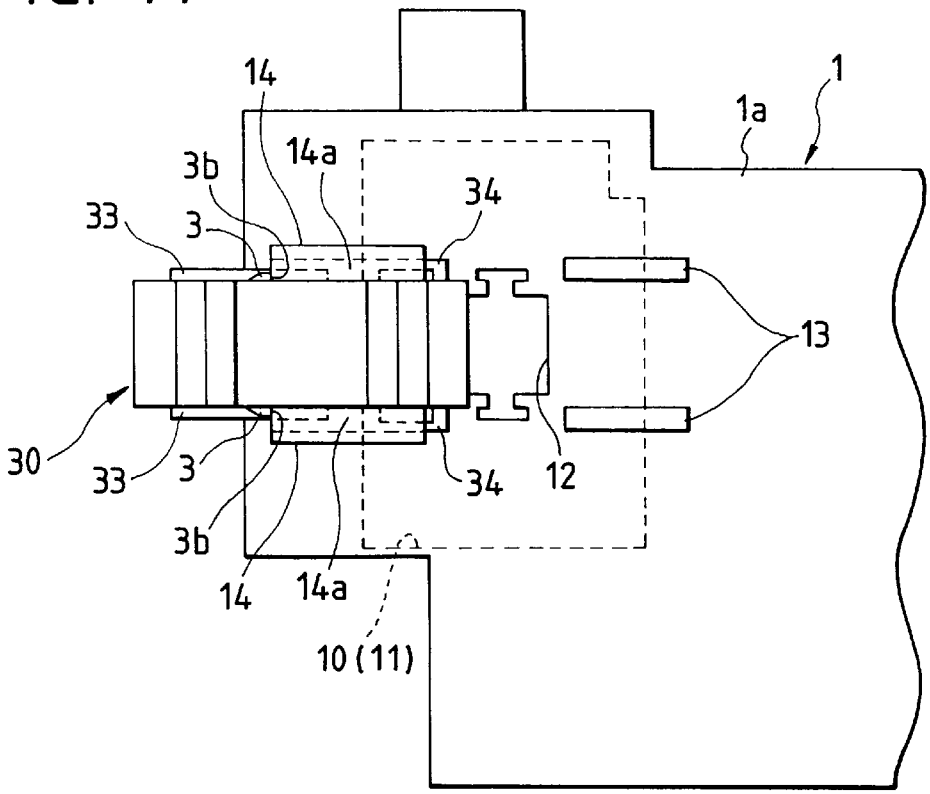
FIG. 11 is a view showing the operation effected when the slider is inserted with its front and rear ends reversed.

FIGS. 7, 8 and 9 show a sequence of the operation effected when the slider 30 is inserted with the directions of its front and rear ends kept proper, and FIGS. 10 and 11 show a sequence of the operation effected when the slider 30 is inserted with the directions of its front and rear ends reversed.

First, the operation, effected when the slider 30 is inserted with the directions of its front and rear ends kept proper, will be first described with reference to FIGS. 7, 8 and 9.

In FIG. 7, the slider 30 is positioned relative to the first connector 10, with the directions of its front and rear ends kept proper, in such a manner that the rails 33 of the slider 30 are disposed close to the first connector 10. Then, the slider 30 is slid in a direction of arrow A (that is, a direction of setting of the slider 30), and is inserted between the holder guides 14.

As a result, as shown in FIG. 8, the inclined surface 3*a* of each projection 3 is brought into sliding contact with the inturned portion 14*a* of the associated holder guide 14, and as the insertion of the slider 30 proceeds, the whole of the projection 3 is retracted to be received in the side wall 31*a*. As a result, the slider 30 can pass past the holder guides 14.

Thereafter, as shown in FIG. 9, the rails 33 of the slider are inserted respectively into the guides 13, and the slider 30 is slid along these guides 13, and is set in a predetermined position on the first connector 10. In this predetermined position of the slider 30, the openings 32*a* of the cam grooves 32 in the slider 30 and the holders 34 are disposed in registry with the through hole 12.

Next, the operation, effected when the slider 30 is inserted with the directions of its front and rear ends reversed, will be described with reference to FIGS. 10 and 11.

In FIG. 10, when the slider 30 is slid in the direction of arrow A to be inserted between the holder guides 14 in such a manner that the holder guides 34 of the slider 30 are disposed close to the first connector 10 (that is, the directions of the front and rear ends of the slider 30 are reversed), the abutment surface 3*b* of each projection 3 abuts against the inturned portion 14*a* of the associated holder guide 14, thereby preventing the insertion of the slider 30, as shown in FIG. 11. As a result, the reverse insertion of the slider 30 can be detected rapidly and easily, and therefore the reverse insertion of the slider 30 is prevented.

Next, the connector insertion/withdrawal operation in the LIF connector of the invention will be described with reference to FIG. 12(*a*) to FIG. 15(*b*).

Figure 12A:
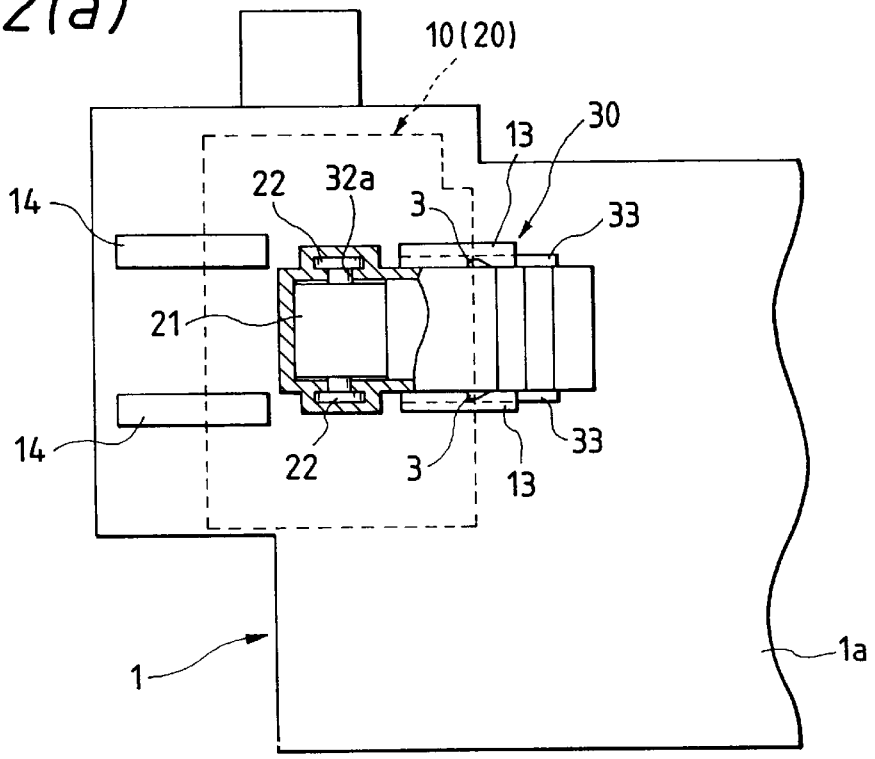
FIGS. 12(*a*) and 12(*b*) are a plan view and a cross-sectional view of the LIF connector, showing a sequence of the connector insertion/withdrawal operation in the LIF connector of the above embodiment.
Figure 12B:
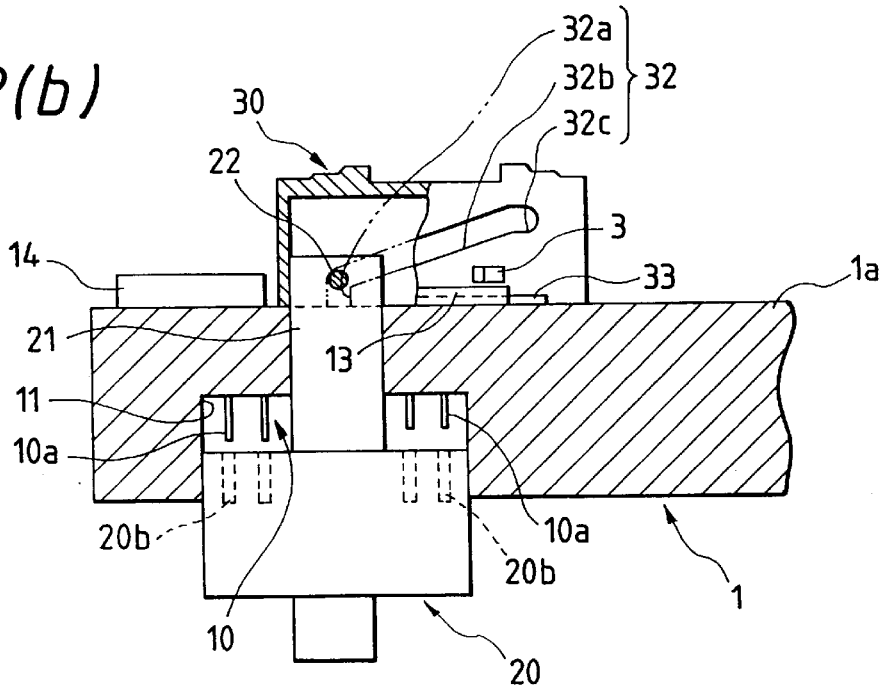

FIGS. 12(*a*) to 15(*b*) show a sequence of the connector insertion/withdrawal operation in the LIF connector of the invention, and FIGS. 12(*a*), 13(*a*), 14(*a*) and 15(*a*) are plan views, and FIGS. 12(*b*), 13(*b*), 14(*b*) and 15(*b*) are cross-sectional views.

In FIGS. 12(*a*) and 12(*b*) (FIG. 12(*a*) shows the same condition as that of FIG. 9), the slider 30 is first set in the predetermined position on the first connector 10. Then, the second connector 20 is inserted into the reception portion 11 of the first connector 10. Then, the openings 32*a* of the cam grooves 32 in the slider 30 are positioned respectively relative to the guide pins 22 on the second connector 20, and the guide pins 22 are introduced respectively into the cam grooves 32 through the respective openings 32*a*.

Figure 13A:
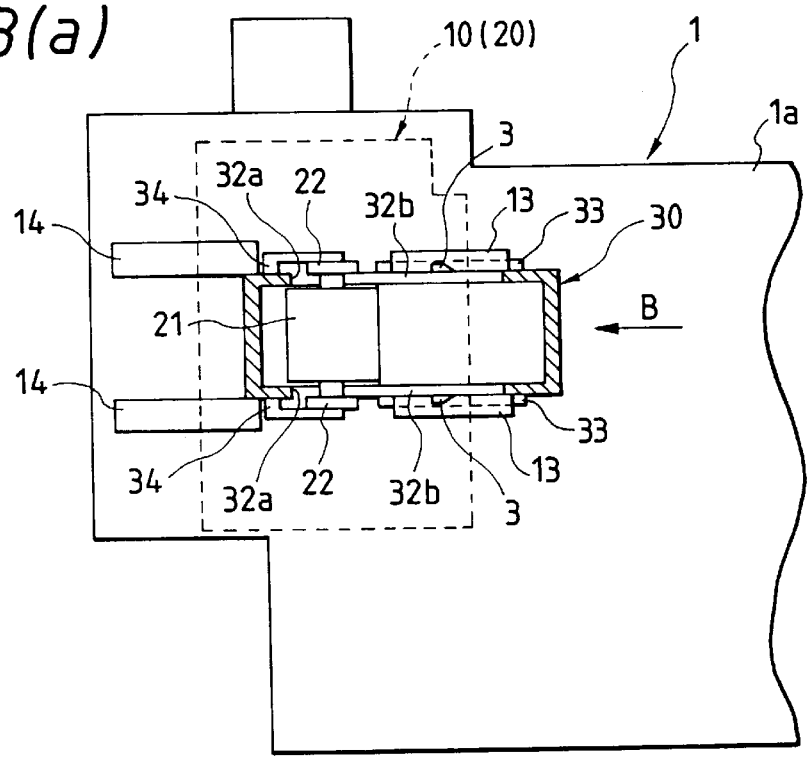
FIGS. 13(*a*) and 13(*b*) are a plan view and a cross-sectional view of the LIF connector, showing a sequence of the connector insertion/withdrawal operation in the LIF connector of the above embodiment.
Figure 13B:
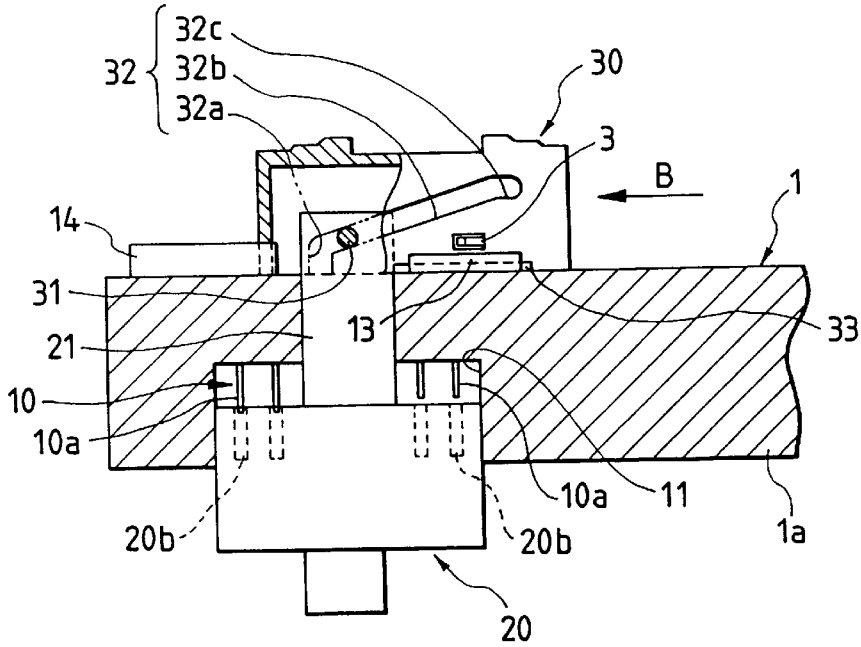

Then, when the slider 30 is slid from the set position in a direction of arrow B as shown in FIGS. 13(*a*) and 13(*b*), the guide pins 22 rise respectively along the slanting grooves 32*b* of the cam grooves 32. As a result, the second connector 20 is pulled toward the upper surface of the reception portion 11 of the first connector 10 through the driven shaft 21.

Figure 14A:
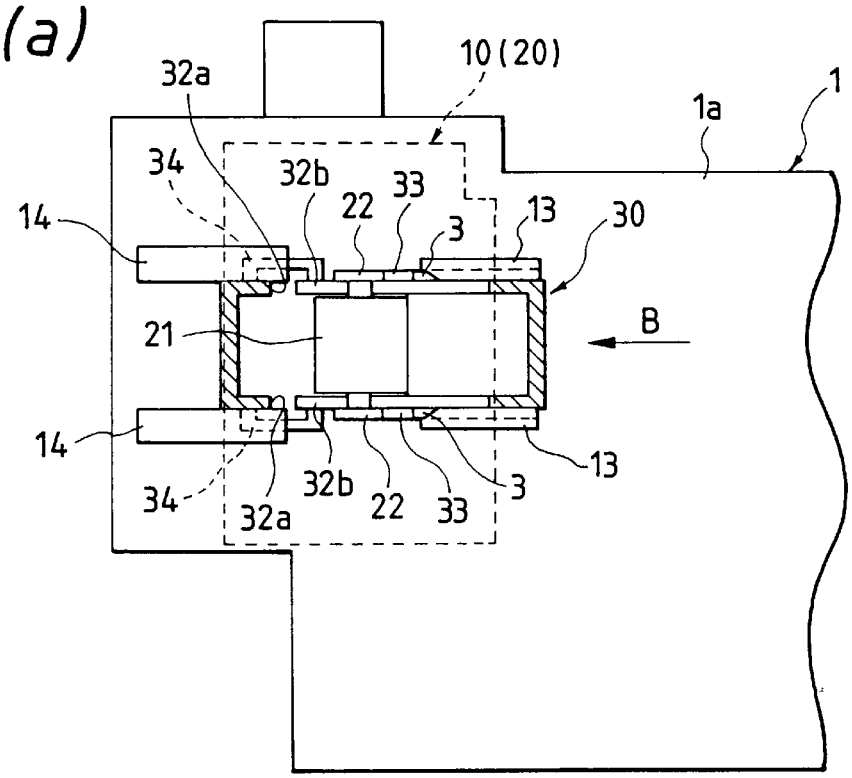
FIGS. 14(*a*) and 14(*b*) are a plan view and a cross-sectional view of the LIF connector, showing a sequence of the connector insertion/withdrawal operation in the LIF connector of the above embodiment.
Figure 14B:
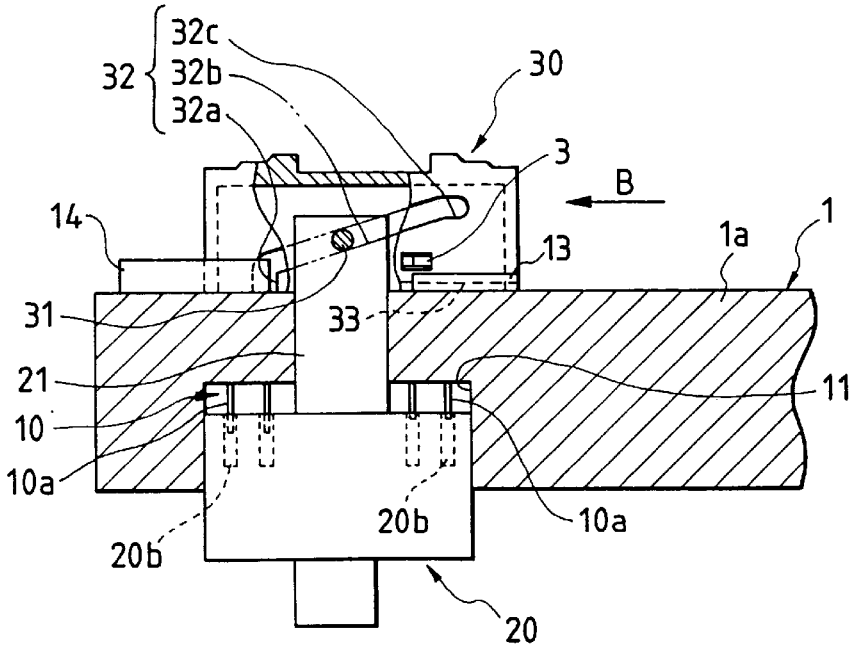
Figure 15A:
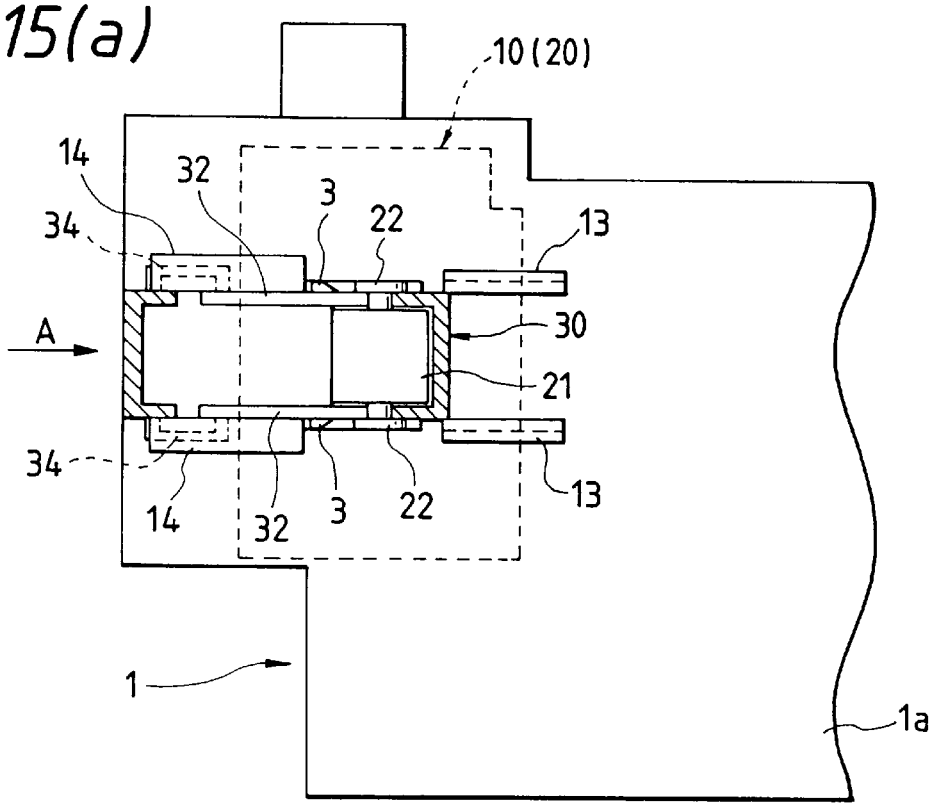
FIGS. 15(*a*) and 15(*b*) are a plan view and a cross-sectional view of the LIF connector, showing a sequence of the connector insertion/withdrawal operation in the LIF connector of the above embodiment.
Figure 15B:
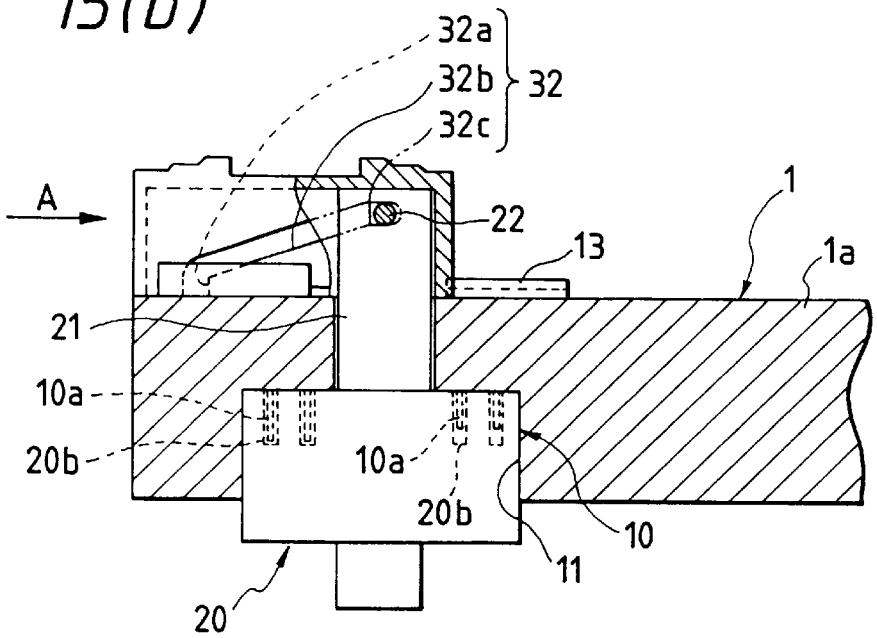

Then, when the slider 30 is further slid in the direction of arrow B as shown in FIGS. 14(*a*) and 14(*b*), each of the guide pins 22 passes past the slanting groove 32*b*, and is introduced into the horizontal groove 32*c* of the cam groove 32 (FIGS. 15(*a*) and 15(*b*). As a result, the second connector 20 is completely inserted into the reception portion 11 of the first connector 10, and the male terminals 10*a* in the first connector 10 are electrically connected respectively to the female terminals 20*b* in the second connector 20.

When the slider 30 is slid until each guide pin 20 passes through the associated slanting groove 32*b*, the abutment surface 3*b* of each projection 3 abuts against the associated holder guide 14, thereby preventing an undue force from being applied to the guide pin 22 and the horizontal groove 32*c*, although this is not shown in the drawings.

For withdrawing the second connector 20 from the first connector 10, the slider 30 in the condition of FIGS. 15(*a*) and 15(*b*) is slid in the direction of arrow A, so that the cam grooves 32 in the slider 30 perform a function reverse to that described above, and therefore the second connector 20 can be withdrawn from the reception portion 11 of the first connector 10.

Figure 1:
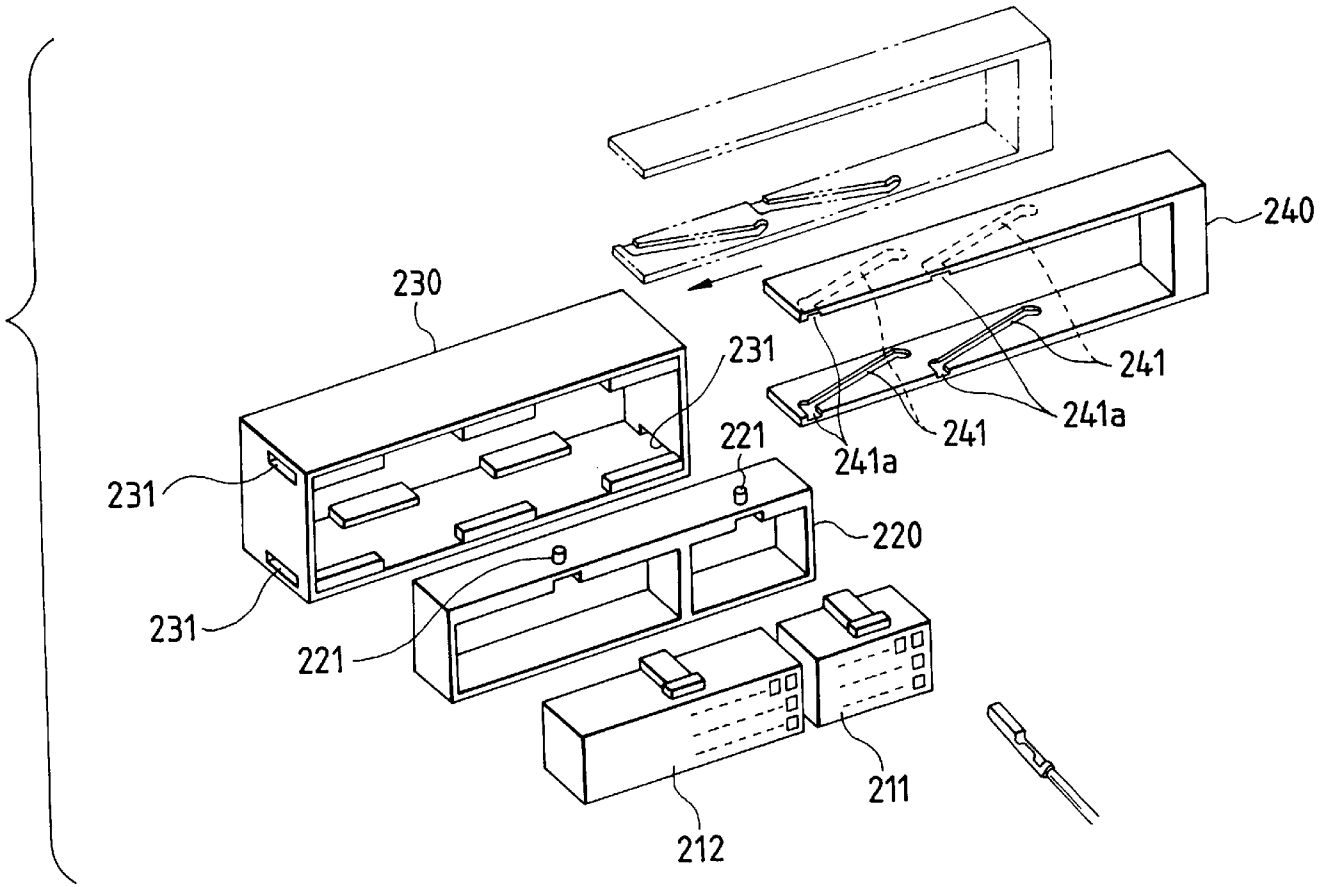
FIG. 1 PRIOR ART
FIG. 1 is an exploded, perspective view of a conventional LIF connector.

In the LIF connector of this embodiment, the slider 30 is slid over the first connector 10, and with this construction the upper and lower sides of the slider 30 can be clearly recognized. Namely, the slider 30 has the open bottom so that it can be connected to the driven shaft 21 of the second connector 20, and therefore the upper and lower sides of the slider 30 can be clearly recognized with the eyes. As a result, the inverted insertion of the slider as encountered with the conventional slider 240 of FIG. 1 is prevented.

The front-rear reversed insertion of the slider 30 is prevented by the retractable projections 3, and with this simple construction the reverse insertion of the slider 30 can be detected rapidly and easily, and the reverse insertion of the slider 30 is prevented.

The LIF connector of the invention is not limited to the above embodiment. For example, although the first connector 10 is integrally formed in the housing 1*a* of the junction box 1, the first connector can have an independent housing.

As described above, in the LIF connector of the present invention, with the simple construction in which the projections are provided on the slider, the reverse insertion of the slider can be detected rapidly and easily.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. An LIF connector with an LIF mechanism comprising:

a first connector;

a second connector inserted into and withdrawn from said first connector;

a slider slidable over said first connector through guides, said second connector being inserted into and withdrawn from said first connector through a sliding motion of said slider; and a pair of retractable projections provided respectively on opposed side walls of said slider, each of said projections having an inclined surface and a substantially vertical abutment surface, wherein when said slider is inserted in a first orientation, said inclined surface is brought into sliding contact with the associated guide to retract said projection to allow insertion of said slider, and when said slider is inserted in a second orientation which is inverted with respect to said first orientation, said abutment surface abuts against the associated guide to prevent the insertion of said slider.

2. The LIF connector according to claim 1, in wherein said first connector includes a reception portion for receiving said second connector, a through hole communicating with said reception portion, and said guides for guiding said slider.

3. The LIF connector according to claim 2, wherein said second connector includes a driven shaft for being inserted into said through hole in said first connector, and guide pins projecting perpendicularly from said driven shaft.

4. The LIF connector according to claim 3, wherein said slider includes a box-like body having an open bottom, slanting cam grooves formed respectively in the opposed side walls of said box so as to respectively guide said guide pins of said second connector, and said projections retractably mounted respectively on said opposed side walls.

* * * * *